US005685233A

United States Patent [19]

DeJean

[11] Patent Number: 5,685,233

[45] Date of Patent: Nov. 11, 1997

[54] RECYCLABLE PALLET ASSEMBLY

[75] Inventor: Milton V. DeJean, Winston-Salem, N.C.

[73] Assignee: Milbe Products, Inc., Winston-Salem, N.C.

[21] Appl. No.: 688,986

[22] Filed: Jul. 31, 1996

[51] Int. Cl.[6] ..... B65D 19/00

[52] U.S. Cl. ..... 108/51.1; 108/51.3; 108/56.1; 108/901

[58] Field of Search ..... 108/51.1, 901, 108/902, 51.3, 56.3, 56.1, 55.3, 55.1

[56] References Cited

U.S. PATENT DOCUMENTS

| | | | |
|---|---|---|---|
| 4,051,787 | 10/1977 | Nishitani et al. | 108/55.3 |
| 4,145,976 | 3/1979 | Svirklys | 108/56.1 |
| 4,802,421 | 2/1989 | Atterby et al. | 108/56.1 X |
| 4,834,001 | 5/1989 | Atterby et al. | 108/51.3 |
| 5,052,307 | 10/1991 | Moriison | 108/901 X |
| 5,170,722 | 12/1992 | Friesner et al. . | |
| 5,402,735 | 4/1995 | DeJean | 108/902 X |
| 5,415,167 | 5/1995 | Sadr | 108/902 X |
| 5,456,189 | 10/1995 | Belle Isle | 108/902 X |
| 5,458,069 | 10/1995 | Stolzman | 108/56.3 |
| 5,531,166 | 7/1996 | Woods et al. | 108/51.3 |

FOREIGN PATENT DOCUMENTS

| | | | |
|---|---|---|---|
| 2713674 | 10/1977 | Germany | 108/55.3 |

*Primary Examiner*—Jose V. Chen
*Attorney, Agent, or Firm*—Christopher C. Dremann; Ralph H. Dougherty

[57] ABSTRACT

A light weight pallet assembly extruded from a recyclable, thermoplastic material is provided for storing, handling and transporting heavy or bulky articles. The pallet assembly includes at least two elongate, generally hollow runners, a plurality of support bars, and fastening members for coupling the support bars to the runners. Each runner includes an upper load supporting surface, a lower surface, a pair of opposed lateral surfaces and at least one, and preferably two, transverse ribs connecting the opposed lateral surfaces. A plurality of longitudinally spaced apertures are formed through at least one of the opposed lateral surfaces of the runner for receiving a respective one of the support bars therein. A plurality of longitudinally spaced apertures are formed through the upper surface of the runner and in at least a portion of at least some of the support bars for receiving the fastening members. The fastening members may be secured with an adhesive or may be press fit. The fastening members are removable to repair a damaged pallet assembly, or to return empty pallets to the owner. The support bars and the upper surface of each runner may be provided with an anti-skid surface for protecting a user walking on the pallet. The opposed ends of each runner may be closed to prevent injury to persons and property, and to prevent foreign objects of any appreciable size, such as the tongues of a forklift, from penetrating the open ends of the runners. A pair of longitudinally spaced recesses may also be formed in the opposed lateral surfaces and the lower surface of each runner so that the pallet assembly may be engaged by the tongues of a forklift from any of four different, orthogonal directions. A spacer pallet assembly is also disclosed.

17 Claims, 5 Drawing Sheets

10
40
30
20
26
27
34
40
30
20
32
20

40
12
30
20
26
27
30
20
20
29

26
14
30
20
40
34
27
29
30
20
20
20
32

RECYCLABLE PALLET ASSEMBLY

BACKGROUND OF THE INVENTION

The invention relates to an apparatus for supporting a predetermined load, and more particularly to a lightweight, recyclable pallet assembly for storing, handling and transporting heavy or bulky articles.

Conventional pallets for use in relocating heavy or bulky articles are manufactured from a plurality of pieces of wood joined together, for example, by nails. Typically, the owner of such pallets requires that the pallets be returned after the articles have been transported. A disadvantage of conventional wooden pallets is that they can weigh as much as one hundred pounds or more. Thus, the cost of freight to return the empty pallets to the owner is high. Another disadvantage of wooden pallets is their inability to be easily repaired when damaged. Accordingly, wooden pallets are typically discarded when they become damaged. However, the options available for disposing of damaged pallets are limited. Wooden pallets are not recyclable, require long periods of time to decompose in landfills, and in many localities cannot be burned because of stringent environmental regulations. In the past, damaged wooden pallets were chipped or shredded, and the wood scrap used for other purposes. This method of disposal, however, requires that the nails be removed, which is a labor intensive process. Thus, it is relatively expensive today to dispose of damaged wooden pallets.

There have been numerous inventions directed to the use of paperboard, recycled paperboard or cardboard pallets to overcome the disadvantages of wooden pallets. Pallets manufactured from paperboard and cardboard, however, are unacceptable alternatives to replace conventional wooden pallets for storing, handling and transporting heavier articles. There has also been a lesser number of inventions directed to pallets made from sturdy plastic materials. Although these inventions directed to plastic pallets overcome some of the disadvantages of conventional wooden pallets, they include deficiencies of their own which have not yet been adequately resolved.

U.S. Pat. No. 5,170,722 describes a pallet assembly having two interlocking sets of runners which may be formed from recyclable, injection molded thermoplastic materials, or from recyclable, injection molded structural foam. However, injection molded pallet assemblies do not offer a user the flexibility to readily dimension a pallet to the dimensions of a predetermined load. For example, if a user requires a pallet having dimensions of 4' by 5', but only a pallet of 4' by 4' can be assembled with the available inventory of runners, replacement runners must be manufactured from different sized injection molds. If the required size injection mold is not available, a mold must be specially manufactured, which is quite expensive. Therefore, it is time consuming and costly to produce a pallet assembly which is injection molded from a thermoplastic or structural foam and is uniquely sized for a predetermined load.

U.S. Pat. No. 5,402,735 describes a lightweight pallet assembly extruded from a recyclable, thermoplastic material. The pallet assembly includes at least two runners having a plurality of apertures therethrough for receiving a plurality of support bars therein. Each of the runners includes an upper load supporting surface, a lower surface having a stabilizer receiving channel formed therein, and a pair of opposed lateral surfaces. The pallet further includes a stabilizer having a plurality of tab members each having fastener receiving apertures therethrough, and a plurality of fasteners for removably mounting the stabilizer to each of the runners. The runners, the support bars and the stabilizer may each be uniquely sized to efficiently interact with a predetermined load to be handled by the pallet assembly.

The stabilizer is removably mounted to the runners so that the pallet assembly may be readily disassembled to facilitate returning empty pallets to the owner, and for repairing damaged pallets. Disassembling the pallets, however, has been found to be a somewhat labor intensive process. Thus, it is often preferable to simply stack assembled pallets for shipping back to the owner rather than to disassemble the pallets before shipping. However, the pallets described in the '735 patent do not nest together optimally because the stabilizer is positioned adjacent the lower surface of the runners and the support bars are positioned adjacent the upper surface of the runners. The stabilizer is positioned opposite the support bars to provide torsional rigidity to the pallet assembly. Thus, the stabilizer cannot be removed or relocated without compromising the structural integrity of the pallet.

It is apparent that an alternative pallet assembly overcoming one or more of the limitations of prior wooden and plastic pallets described above would be advantageous. The foregoing disadvantages illustrate the need for a lightweight pallet assembly extruded from a recyclable, thermoplastic material which may be uniquely sized to efficiently handle a predetermined load without compromising the structural integrity of the pallet. Accordingly, it is an object of the invention to provide a lightweight pallet assembly extruded from a recyclable, thermoplastic material which can be uniquely sized to support a predetermined load. It is another object of the invention to provide a pallet assembly extruded from a thermoplastic material which is strong enough to support a heavy load without the use of a stabilizer positioned adjacent the lower surface of the runners opposite the support bars. It is another object of the invention to provide a pallet assembly which may be readily disassembled to be repaired, but which may be optimally nested to be returned to the owner without disassembling the pallet. The present invention provides such a suitable alternative including features which are more fully described hereinafter.

SUMMARY OF THE INVENTION

The invention is an improved lightweight pallet assembly which may be uniquely sized to efficiently handle a predetermined load. The pallet assembly is extruded from a recyclable, thermoplastic material and is strong enough to support a heavy load. The pallet assembly may be readily disassembled to be repaired, but may also be optimally nested to be returned to the owner without the need to disassemble the pallet.

The pallet assembly includes at least two elongate, generally hollow runners that are sized to support the predetermined load. Each of the runners includes an upper load supporting surface, a lower surface opposite the upper surface, and a pair of opposed lateral surfaces. At least one of the pair of opposed lateral surfaces has a plurality of longitudinally spaced apertures formed therethrough. Each runner also includes at least one, and preferably two, elongate, transverse ribs connecting the pair of opposed lateral surfaces.

The pallet assembly further includes a plurality of elongate support bars and fastening means for coupling at least two of the support bars to the at least two runners. Each support bar is received within a respective one of the apertures formed through the at least one of the pair of opposed lateral surfaces of the each runner. Preferably, a plurality of longitudinally spaced apertures for receiving the fastening means are formed through the upper surface of each runner and in at least a portion of at least some of the support bars. The fastening means preferably includes a plurality of fastening members, each secured within a respective one of the apertures formed through the upper surface of the runner and at least some of the support bars. The fastening means are secured in a conventional manner, such as with an adhesive or by an interference, or press, fit. The fastening means may be removed, preferably by drilling them out, to disassemble the pallet assembly for repair.

The number of apertures formed through at least one of the pair of opposed lateral surfaces of each runner is preferably greater than the number of apertures formed through the upper surface of each runner, and the corresponding number of apertures formed in at least some of the support bars. Thus, a sufficient number of support bars may be provided so that the gap between each pair of adjacent support bars is relatively small, while the number of fastening members which must be removed to disassemble the pallet is not excessive. A spiral groove may also be formed in the exterior surface of at least a portion of each support bar to provide an anti-skid surface for protecting a user walking on the pallet. In an alternative embodiment, the exterior surface of at least a portion of each support bar may be roughened by applying a coating consisting of sand grit, or other particulate, intermixed with an adhesive to the exterior surface of the support bar.

A pallet assembly uniquely sized to efficiently interact with a predetermined load can readily be manufactured by extruding different lengths of runners and support bars. Thus, a light duty pallet, a standard duty pallet or a heavy duty pallet can readily be manufactured by varying the length and increasing the number of runners and support bars as required. A standard duty pallet, for example, may be constructed in the manner described above using a single center runner, a pair of opposed outer runners, and a predetermined number of standard length support bars. A heavy duty pallet, for example, may be constructed in the manner described above using a pair of center runners, a pair of opposed outer runners, and a predetermined number of extended length support bars. A pair of elongate, longitudinally spaced apart recesses may also be formed in the lower surface and the opposed lateral surfaces of each runner to produce a "four-way entry" pallet. A four-way entry pallet has the additional advantage that a forklift may engage the pallet from any of four orthogonal directions.

The opposed ends of each runner may be closed to prevent injury to persons and property, and to prevent foreign objects of any appreciable size, such as the tongues of a forklift, from penetrating the open ends of the runners. In one embodiment, a pair of cuts are made in the longitudinal direction between each of the opposed lateral surfaces and the upper surface, the lower surface, and the transverse ribs at each opposed end of the runner. The end of the runner is then softened by heating, and the end of the upper surface is folded downward, the end of the lower surface is folded upward, and the ends of the ribs are folded in the direction of the upper surface and the lower surface, respectively. The opposed lateral surfaces are then folded inwardly so as to cover at least a portion of the ends of the runner. In another embodiment, an elastomeric endcap may be manufactured in a conventional manner and positioned within each of the opposed ends of the runner. An additional advantage of an elastomeric endcap is that it acts as a bumper in the event that the operator of the forklift strikes a wall or another object while transporting the pallet assembly.

In a preferred embodiment, each runner includes a pair of elongate, vertically spaced apart, transverse connecting ribs which divide the runner into a longitudinally extending center cell, and a pair of opposed longitudinally extending outer cells. Accordingly, the flexural rigidity (bending stiffness) of the runner is improved as compared to previous pallet assemblies extruded from recyclable, thermoplastic materials. One of the outer cells is located adjacent the plurality of apertures formed through the at least one of the pair of opposed lateral surfaces of the runner which receive the plurality of support bars. The cell is sized such that the support bar has a slight clearance, or slip, fit with the aperture and the outer cell of the runner. Accordingly, the torsional rigidity of the runner is improved as compared to previous pallet assemblies extruded from recyclable, thermoplastic materials.

Because pallet assemblies manufactured according to the invention do not include a stabilizer located adjacent the lower surface opposite the support bars, they may be optimally nested for returning the empty pallets to the owner. A spacer pallet assembly uniquely sized to separate a plurality of predetermined loads can also be extruded from recyclable, thermoplastic materials according to the invention. The spacer pallet assembly further includes a pair of longitudinally spaced support bar receiving apertures adjacent the lower surface of each runner. Thus, a pair of support bars may be positioned adjacent the lower surface of the runner opposite the plurality of support bars positioned adjacent the upper surface of the runner.

BRIEF DESCRIPTION OF THE DRAWINGS

While some of the objects and advantages of the invention have been stated, others will become apparent as the preferred embodiments of the invention are described in connection with the accompanying drawings in which.

DETAILED DESCRIPTION OF THE PREFERRED EMBODIMENTS

Figure 1:
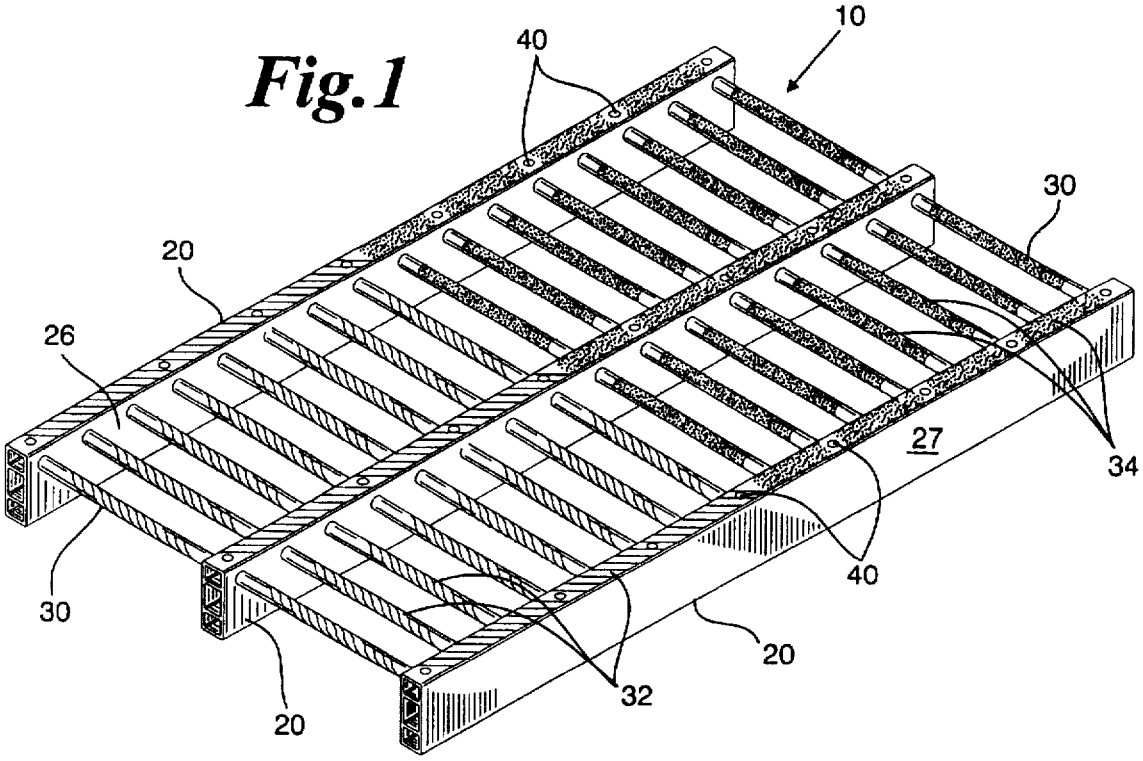
FIG. 1 is a perspective view of a standard duty pallet assembly manufactured according to the invention.

Referring now to the drawings, wherein like numerals indicate like elements, pallet assemblies indicated generally at 10, 12, 14 and 16, manufactured according to the invention are shown in FIGS. 1–3 and 7, respectively. The pallet assemblies include at least two elongate, generally hollow runners 20, a plurality of support bars 30, and fastening means 40 for coupling the support bars to the runners. The runners 20 and the support bars 30 are extruded from a recyclable, thermoplastic material such as polyvinylchloride (PVC), polypropylene, polyester or polyethylene. The use of extruded, rather than injection molded, thermoplastic runners 20 and support bars 30 permits the pallet assemblies to be uniquely sized to efficiently handle a predetermined load.

Figure 2:
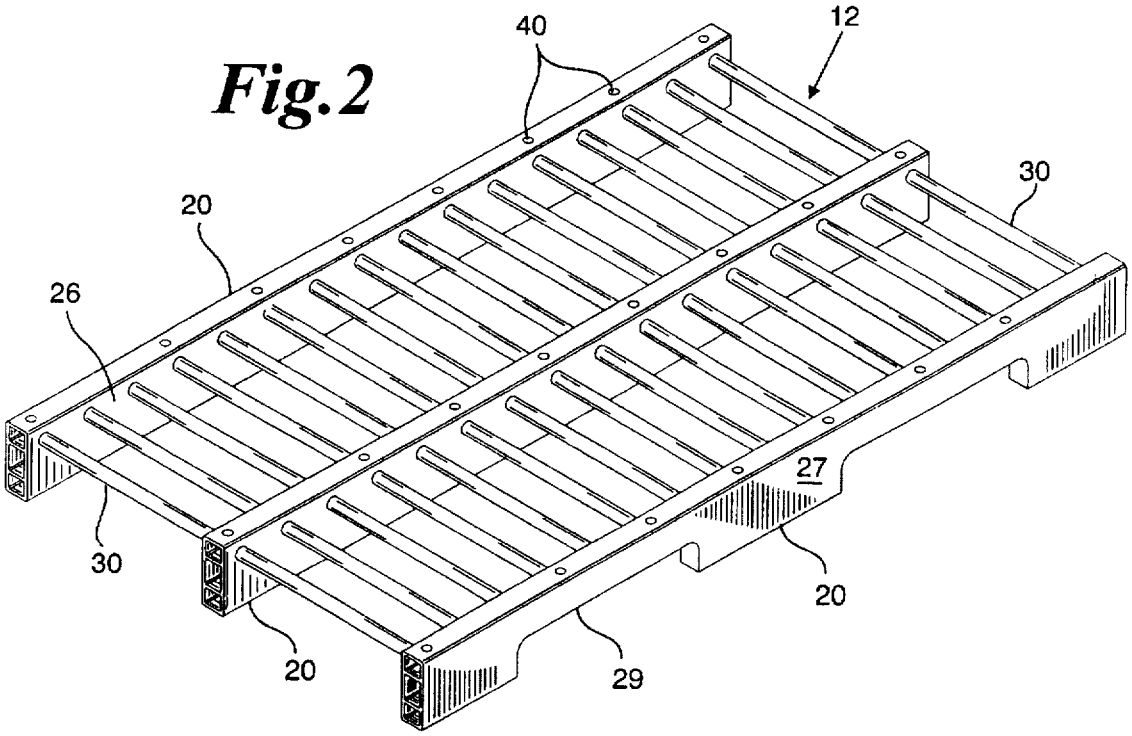
FIG. 2 is a perspective view of a four-way entry, standard duty pallet assembly manufactured according to the invention.
Figure 3:
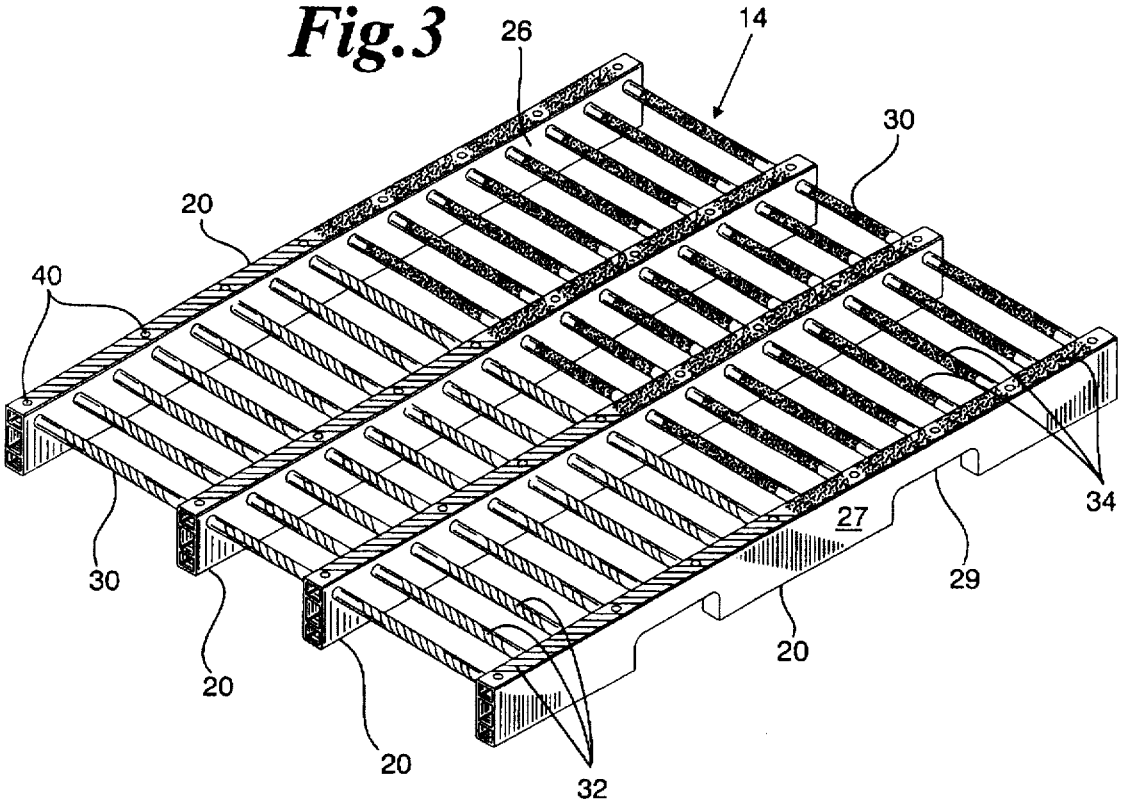
FIG. 3 is a perspective view of a four-way entry, heavy duty pallet assembly manufactured according to the invention.
Figure 7:
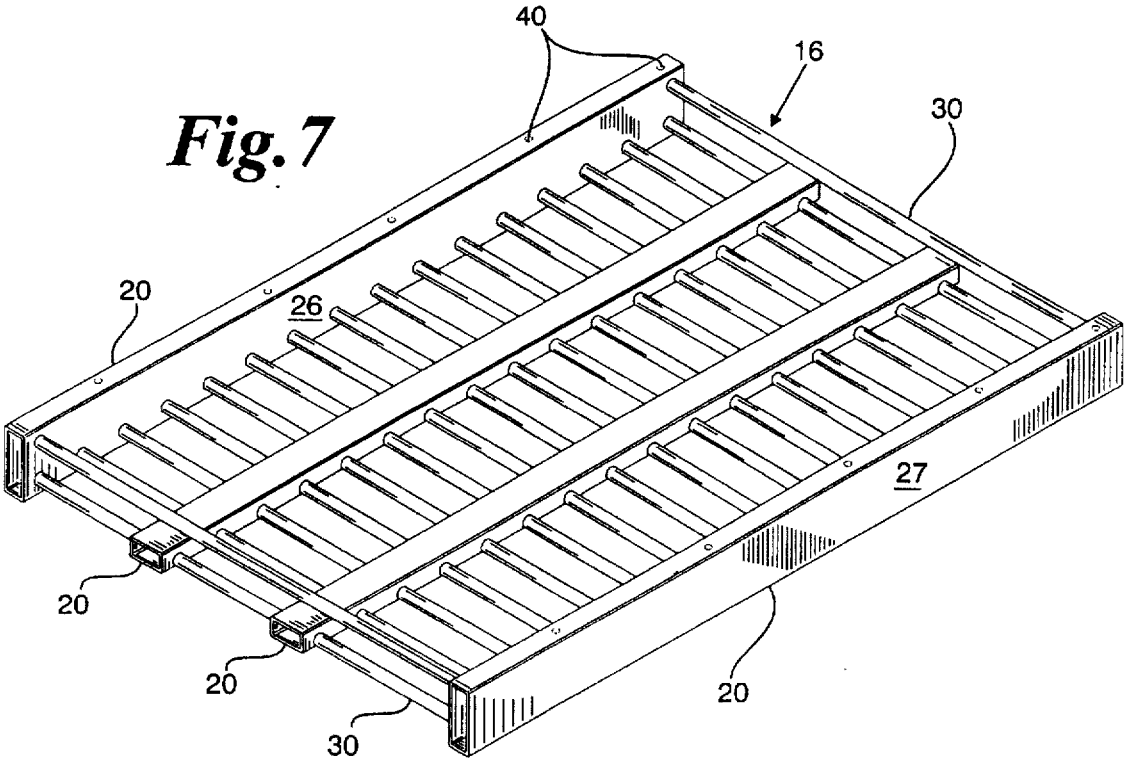
FIG. 7 is a perspective view of a spacer pallet assembly manufactured according to the invention.

FIG. 1 illustrates a standard duty pallet assembly 10 comprising a center runner 20 and a pair of opposed outer runners 20. The standard duty pallet may have any desired dimensions, for example 40 inches by 48 inches, and any suitable number of support bars 30, for example sixteen as shown. FIG. 2 illustrates a fourway entry, standard duty pallet assembly 12, as will be described hereinafter. FIG. 3 illustrates a heavy duty pallet assembly 14 comprising a pair of center runners 20 and a pair of opposed outer runners 20. Similarly, the heavy duty pallet assembly 14 may have any desired dimensions, such as 40 inches by 54 inches, and any suitable number of support bars 30. FIG. 7 illustrates a spacer pallet assembly 16, as will be described hereinafter.

Figure 4A:
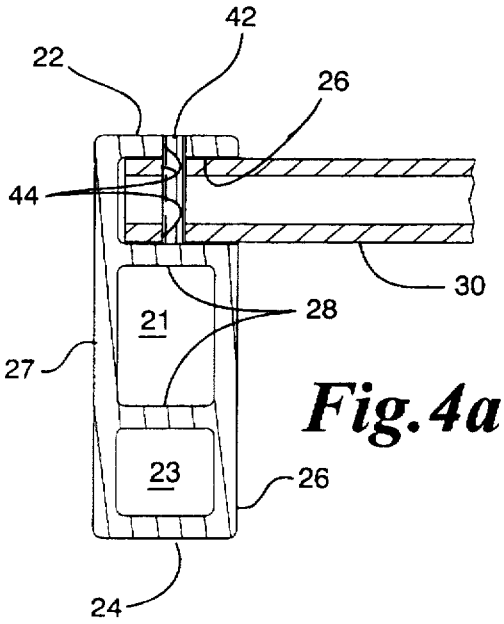
FIG. 4*a* is a typical cross sectional view of a runner of the pallet assembly of FIG. 1 illustrating a preferred embodiment of the fastening means of the invention.
Figure 4B:
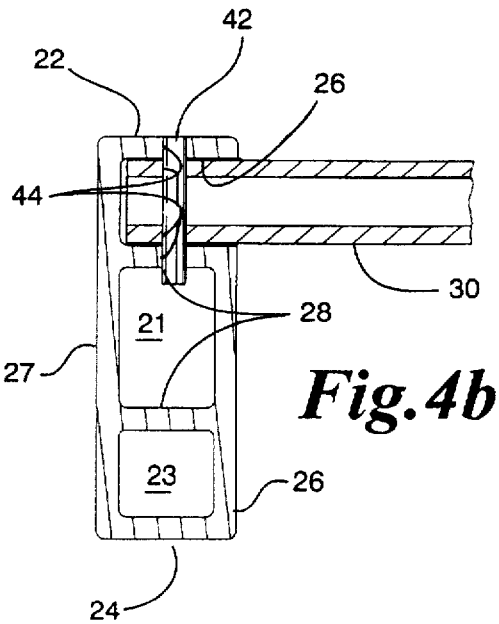
FIG. 4*b* is a typical cross sectional view of a runner of the pallet assembly of FIG. 1 illustrating an alternative embodiment of the fastening means of the invention.

As best shown in FIGS. 4*a* and 4*b*, each runner 20 comprises an upper load supporting surface 22, a lower surface 24 opposite the upper surface, and a pair of opposed lateral surfaces 26, 27. Each runner 20 further comprises at least one, and preferably two, elongate, transverse ribs 28 connecting the pair of opposed lateral surfaces 26, 27. The upper surface 22, the lower surface 24, and the ribs 28 are preferably parallel. The opposed lateral surfaces 26, 27, are likewise, preferably parallel. Thus, the runner 20 preferably defines a parallelogram cross section. More preferably, the cross section of the runner 20 is rectangular with opposed lateral surfaces 26, 27 having the greater length as shown. The transverse ribs 28 divide the runner 20 into at least two, and preferably three, longitudinally extending cells. In the preferred embodiment shown, the transverse ribs 28 divide the runner 20 into a center cell 21 and a pair of opposed outer cells 23.

At least one of the pair of opposed lateral surfaces 26, 27 has a plurality of longitudinally spaced apertures 25 formed therethrough. Each support bar 30 is received within a respective one of the apertures 25 formed through the at least one of the pair of opposed lateral surfaces 26, 27 of the runner 20. The apertures 25 are formed through both lateral surfaces 26, 27 of a center runner 20, but are preferably formed through only the inner lateral surface, 26, of each outer runner 20. Thus, the support bars 30 are prevented from migrating outwardly. The apertures 25 are arranged symmetrically in the longitudinal direction of the runner 20 so that the same runner may be used for either a left-hand or a right-hand outer runner 20.

The support bars 30 may have any cross section, such as square, rectangular or circular, and may be solid or hollow. A solid cross section increases the strength of the pallet assembly, and thus is preferably utilized to manufacture a heavy duty pallet assembly 14. A hollow cross section reduces the weight of the pallet assembly, and thus is preferably utilized to manufacture a standard duty pallet assembly 10, 12. The use of hollow runners 20 and support bars 30 has been found to reduce the weight of the standard duty pallet assembly 10, 12 to about 22 pounds, as compared to a standard duty pallet assembly made of wood which may weigh as much as about 100 pounds. A spiral groove 32 may be formed in the exterior surface of at least a portion of each support bar 30 to provide an anti-skid surface for protecting a user walking on the pallet. The spiral groove 32 may, for example, be about 0.005 inches deep and about 0.030 inches wide.

In an alternative embodiment, the exterior surface of at least a portion of each support bar 30 may be roughened to provide an anti-skid surface. The exterior surface of the support bar 30 may be roughened, for example, by applying a coating consisting of sand grit, or other particulate, intermixed with an adhesive, such as an epoxy resin. Preferably, the adhesive is applied from a sprayer nozzle onto the support bar 30, and the sand grit is dusted onto the support bar while the adhesive is still tacky. Grooves 32 or sand grit 34 may also be provided on the upper surface 22 of each runner 20. In FIGS. 1 and 3, the upper halves of the pallet assemblies are shown with sand grit 34 and the lower halves are shown with grooves 32. The grooves 32 or sand grit 34 have been found to protect a user who walks on the pallet from slipping, even if the pallet is wet.

The fastening means 40 couples at least two of the support bars 30 received within a respective one of the apertures 25 formed through at least one of the pair of opposed lateral surfaces 26, 27 to the runners 20. The fastening means 40 may comprise, for example, an adhesive, such as an epoxy resin, which is applied to the periphery of the aperture 25 and to the exterior surface of the support bar 30 adjacent the apertures. In this embodiment, the aperture 25 is only slightly larger than the external diameter of the support bar 30 so that the support bar will have a slight interference, or press, fit with the aperture. Preferably, however, fastening means 40 comprises fastening members 42 received within a plurality of apertures 44 formed through the upper surface 22 of the runners 20 and in at least a portion of the at least some support bars 30.

As illustrated in FIG. 4*a*, the support bar 30 is received within the aperture 25 formed through the lateral surfaces 26 of the runner 20. Apertures 44 are then formed, such as by drilling, through upper surface 22 of runner 20 and in at least a portion of the support bar 30. As shown, apertures 44 are formed through both the upper and lower walls of the support bar 30 to increase the strength of the joint. However, an aperture 44 may be formed through only the upper wall of the support bar 30 to reduce the amount of time required for assembly of the pallet assembly. The fastening members 42 are secured within the apertures 44 in a conventional manner, such as with an adhesive as previously described, or by a press fit.

In the event that a pallet assembly must be disassembled, for example to repair a damage portion of the pallet assembly, the fastening members 42 are removable. The fastening members may be removed by softening the runner 20 and the support bar 30, such as by heating, to loosen the bond of the adhesive or the press fit. Preferably, however, the fastening members 42 are removed by drilling out the fastening member through the upper surface 22 of the runner 20, the upper and lower walls of the support bar 30, and the upper transverse rib 28 as illustrated in FIG. 4*b*. The fastening member 42 is drilled out through the upper transverse rib 28 so that the filings of the fastening member collect in center cell 21 of runner 20. A longer fastening member 42 is then secured within the new apertures 44 in a similar manner to reassemble the pallet assembly after repair.

The number of apertures 25 formed through the at least one of the pair of opposed lateral surfaces 26, 27 of each runner 20 is preferably greater than the number of apertures 44 formed through the upper surface 22 of the runner and the corresponding number of apertures 44 formed in the respective support bars 30. Thus a sufficient number of support bars 30 is provided so that the gap between each pair of adjacent support bars is relatively small, while the number of fastening members 42 needed to assemble the pallet assembly (and which must be removed to disassemble the pallet assembly) is not excessive. Preferably, the gap between each pair of adjacent support bars 30 does not exceed about two inches, and fastening members 42 engage every other support bar 30. However, the number of support bars 30 and the number of fastening members 42 may be varied to obtain the desired geometry and strength characteristics of a particular pallet assembly.

Figure 5A:
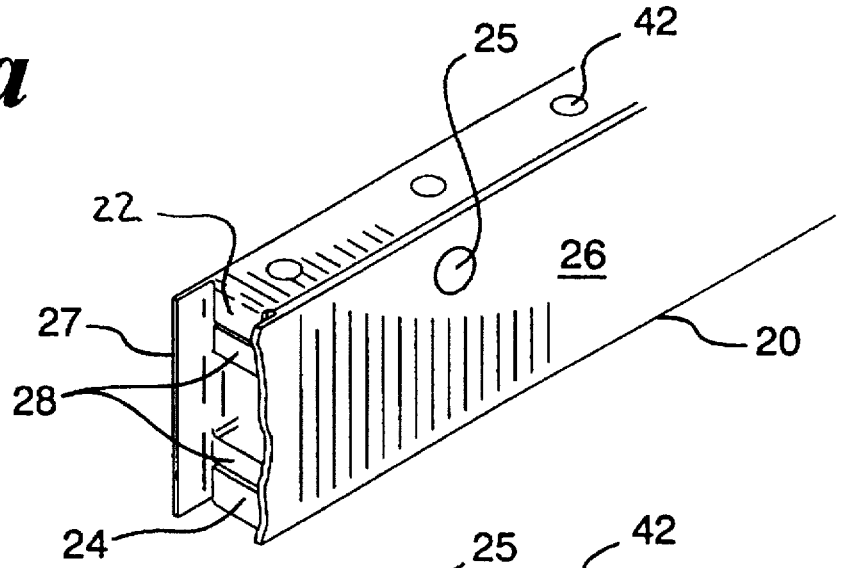
FIG. 5*a* and 5*b* are perspective end views illustrating a preferred method of forming an endcap for the runner of a pallet assembly manufactured according to the invention.
Figure 5B:
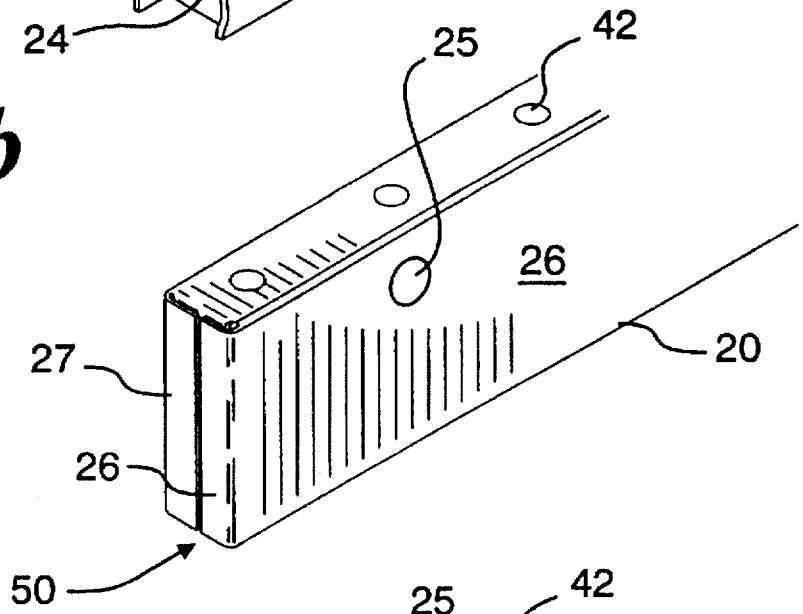

It has been found that it is advantageous to close the opposed ends of each runner 20 with an endcap 50. The endcap 50 prevents injury to persons and property, and prevents foreign objects of any appreciable size, such as the tongue of a forklift, from penetrating the open end of the runner 20. FIGS. 5*a* and 5*b* illustrate a preferred method of forming an endcap 50 in the opposed ends of runner 20. A pair of longitudinal cuts are made, for example with a band saw, between each of the opposed lateral surfaces 26, 27 and the upper surface 22, the lower surface 24, and the transverse ribs 28 at each opposed end of the runner 20. The end of the runner 20 is then softened, preferably by heating. The end of the upper surface 22 is folded downward, the end of the lower surface 24 is folded upward, and each of the transverse ribs 28 is folded in the direction of the upper surface and lower surface, respectively. The opposed lateral surfaces 26, 27 are then folded inwardly so that at least a portion of each opposed end of the runner 20 is closed. Thus, a tongue of a forklift cannot penetrate the open end of the runner 20 and thereby damage the pallet assembly or upset the load supported by the pallet assembly.

Figure 6:
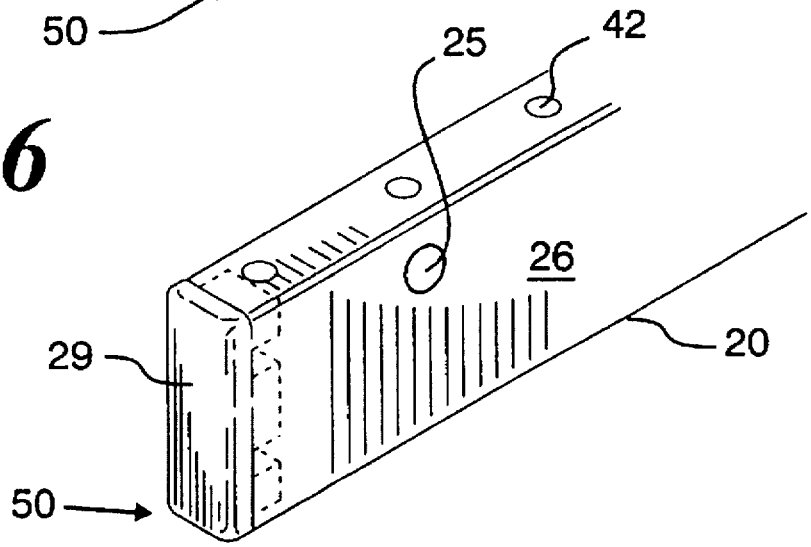
FIG. 6 is a perspective end view of an alternative embodiment of an endcap for the runner of a pallet assembly manufactured according to the invention.

In an alternative embodiment, illustrated in FIG. 6, an endcap 50 made of an elastomeric material such as rubber or soft polyvinylchloride (PVC) may be manufactured in a conventional manner and positioned within each of the opposed ends of the runners 20. The endcap 50 comprises protrusions, indicated in phantom lines, which match the configuration of center cell 21 and outer cells 23. An additional advantage of the elastomeric endcap 50 is that it acts as a soft bumper in the event that the operator of the forklift strikes a wall or another object while transporting the pallet assembly.

The preferred embodiment of the cross section of the runner 20 illustrated in FIGS. 4*a* and 4*b* provides improved strength as compared to the cross sections of previous runners extruded from recyclable, thermoplastic materials. The cross section of the runner 20 includes a pair of elongate, spaced apart transverse ribs 28 which divide the runner into a longitudinally extending center cell 21, and a pair longitudinally extending, opposed outer cells 23 as described above. Preferably, the center cell 21 is about twice as deep as each of the opposed outer cells 23. The ribs 28 may extend the entire longitudinal length of the runner 20, or may be spaced as desired to receive apertures 44 and fastening members 42 as shown in FIG. 5*b*. Regardless, the flexural rigidity (i.e., bending stiffness) of the runner 20 greatly exceeds the flexural rigidity of previous runners having a cross section, for example, that is channel, or "U", shaped. The lower surface 24 closes the cross section of the runner 20, and the ribs 28 reduce the composite moment of inertia of the runner.

The torsional rigidity of the runner 20 is likewise improved as compared to the torsional rigidity of previous runners extruded from recyclable, thermoplastic materials. One of the outer cells 23 of the runner 20 is located adjacent the plurality of longitudinally spaced apertures 25 formed through the at least one of the pair of opposed lateral surfaces 26, 27 of the runner which receive the plurality of support bars 30. The outer cell 23 is preferably sized such that the external diameter of the support bar 30 has a slight interference fit or a slip fit with the aperture 25, and with the upper surface 22, the rib 28, and the opposed lateral surfaces 26, 27 which define the outer cell. The lower surface 24 closes the cross section of the runner 20, and the interaction of the outer cell 23 with the support bars 30 reduces the effective torque box of the runner. Therefore, torque loads applied to the pallet assembly by the support bars 30 are absorbed by the improved torsional rigidity of the runner 20.

A four-way entry, standard duty pallet assembly 12 manufactured according to the invention is illustrated in FIG. 2. A four-way entry pallet assembly has the additional advantage that a forklift can engage the pallet from any of four different orthogonal directions. A pair of recesses 29 are formed in the lower surface 24 and the opposed lateral surfaces 26, 27 of each runner 20. The recesses 29 may be formed in any conventional manner, such as by cutting with a band saw, grinding or milling. The recesses 29 further reduce the weight of the pallet assembly, thus resulting in lower freight costs for returning empty pallets to the owner. As shown FIG. 3, recesses 29 may also be formed in a heavy duty pallet assembly 14. However, the recesses 29 formed in the runners 20 of the heavy duty pallet assembly 14 are necessarily shorter in longitudinal length to maintain the strength requirements of the heavy duty pallet assembly.

Prior pallet assemblies extruded from recyclable thermoplastic materials have been designed to be readily disassembled after use so that an increased number of empty pallets can be returned to the owner at one time, thereby reducing freight costs. Such pallet assemblies (see U.S. Pat. No. 5,402,735 described herein) include a stabilizer bar which is located adjacent to the lower surface of the runner, and opposite the support bars. Accordingly, the pallet assemblies described in the '735 patent do not nest together optimally. The fasteners which couple the stabilizer bar to the runners must be removed and the pallets disassembled to return the empty pallets, and the pallets must be reassembled after they are returned to the owner to be used again.

The pallet assemblies 10, 12, 14, 16 manufactured according to the invention do not include a stabilizer bar located adjacent to the lower surface 24 of the runners 20. Accordingly, the pallet assemblies 10, 12, 14, 16 nest together optimally for returning the empty pallets to the owner without the need to first disassemble the pallets. In most instances, two pallet assemblies manufactured according to the invention can be nested together in the vertical space which is required for each pallet assembly manufactured according to the '735 patent. It has been found that the cost of the time and labor required to disassemble the pallet assemblies exceeds the cost savings obtained by shipping a greater number of disassembled pallets together as taught by the '735 patent. Thus it is an advantage that pallet assemblies manufactured according to the invention may readily be disassembled for repair, while nesting optimally for returning empty pallet assemblies to the owner.

A spacer pallet assembly 16 manufactured according to the invention is illustrated FIG. 7. The spacer pallet assembly 16 is shown inverted in FIG. 7 for clarity. The spacer pallet assembly 16 comprises a pair of center runners 20 and a pair of opposed outer runners 20. As shown, the depth direction of the center runners 20 is preferably oriented in the direction of the support bars 30. As previously described, a plurality of longitudinally spaced apertures 25 and a plurality of support bars 30 are provided adjacent to the upper surface 22 of the outer runners 20. At each opposed end, each of the outer runners 20 has an aperture 25 formed therethrough adjacent the lower surface 24 of the runner. The apertures 25 adjacent the lower surface 24 receive a pair of support bars 30. Thus, the spacer pallet assembly 16 may be positioned between adjacent loads to be transported so that a plurality of loads may be stacked and secured together, such as by baling with string, wire or bungee cord. Spacer pallet assemblies 16 cannot be optimally nested in the same manner as the standard duty pallet assemblies 10 and the heavy duty pallet assemblies 14. The spacer pallet assembly 16 may be disassembled as previously described for returning the empty pallets to the owner. But preferably, the depth of the outer runners 20 may be made smaller than, and preferably about half, the depth of the outer runners 20 of the standard duty pallet assembly 10 and the heavy duty pallet assembly 14.

It should be noted that smaller or larger pallet assemblies than those shown in the illustrated embodiments may be manufactured according to the invention. It should likewise be noted that fewer fastening members 42 than the number shown in the illustrated embodiments may be utilized for applications where it is desired that the pallet assemblies be readily disassembled for returning the empty pallets to the owner. It should also be noted that scrap from the extrusion process may be recycled to extrude new runners 20 and support bars 30, and that damaged runners and support bars may be ground or chipped and recycled to extrude components for new pallet assemblies. It should also be noted that the preferred cross section of runners manufactured according to the invention are strong enough so that the pallet assembly does not require the use of a stabilizer as in previous pallet assemblies. It should also be noted that pallet assemblies manufactured according to the invention can be optimally nested for returning the empty pallets to the owner.

From the foregoing detailed description, it is readily apparent that the invention provides a pallet assembly extruded from a recyclable, thermoplastic material which may be uniquely sized to handle a predetermined load. It is to be understood that the foregoing description and specific embodiments shown herein are merely illustrative of the best mode of the invention and the principals thereof. Accordingly, modifications and additions may easily be made to the apparatus by those skilled in the art without departing from the spirit and scope of the invention, which is therefore understood to be limited only by the scope of the appended claims.

That which is claimed is:

1. A pallet assembly comprising at least two elongate, generally hollow, runners sized to support a predetermined load, each of said runners comprising an upper load supporting surface, said upper surface having a plurality of longitudinally spaced apertures formed therethrough;

a lower surface;

a pair of opposed lateral surfaces, at least one of said pair of opposed lateral surfaces having a plurality of longitudinally spaced apertures formed therethrough; and at least one transverse rib connecting said pair of opposed lateral surfaces; and a plurality of elongate support bars having opposed ends, the opposed ends of each of said support bars received within a respective one of the apertures formed through said at least one of said pair of opposed lateral surfaces of said runners, at least some of said support bars having an aperture formed therein adjacent each of the opposed ends corresponding to a respective one of the apertures formed through said upper surface of each of said runners;

wherein the number of apertures formed through said upper surface of each of said runners is less than the number of apertures formed through said at least one of said pair of opposed lateral surfaces of said runner; and wherein the number of apertures formed in each of the opposed ends of the at least some of said support bars is less than the number of apertures formed through said at least one of said pair of opposed lateral surfaces of said runner; and wherein the apertures formed through said upper surface of each of said runners and the apertures formed in at least some of said support bars receive fastening means therein for coupling at least two of said plurality of support bars to each of said runners.

2. A pallet assembly according to claim 1 wherein said runners and said plurality of support bars are extruded from a thermoplastic material.

3. A pallet assembly according to claim 1 wherein said fastening means comprises a plurality of fastening members, each of said fastening members removably secured within a respective one of the apertures formed through said upper surface of each of said runners and within one of the corresponding apertures formed in the opposed ends of the at least some of said support bars.

4. A pallet assembly according to claim 1 wherein said plurality of support bars are generally hollow.

5. A pallet assembly according to claim 1 wherein each of said at least two runners further comprises an elongate recess formed in said lower surface and in each of said pair of opposed lateral surfaces.

6. A pallet assembly according to claim 1 wherein said at least two runners comprise a center runner and a pair of opposed outer runners.

7. A pallet assembly according to claim 1 wherein said at least two runners comprise a pair of center runners and a pair of opposed outer runners.

8. A pallet assembly according to claim 1 wherein the external surface of at least a portion of at least some of said plurality of support bars is roughened.

9. A pallet assembly according to claim 10 wherein the external surface of at least a portion of at least some of said support bars is coated with an anti-skid coating comprising a mixture of an adhesive and a particulate.

10. A pallet assembly according to claim 1 further comprising an elastomeric endcap positioned within each of the opposed ends of said runner so that said endcap covers at least a portion of each of the opposed ends of said runner.

11. A pallet assembly according to claim 1 wherein said at least one transverse rib comprises at least two spaced apart ribs which divide said runner into at least three longitudinally extending cells.

12. A pallet assembly according to claim 11 wherein said at least one transverse rib comprises a pair of spaced apart ribs positioned between said upper surface and said lower surface which divide said runner into a longitudinally extending center cell and a pair of longitudinally extending, opposed outer cells, one of said pair of outer cells being adjacent to the plurality of apertures formed through said at least one of said pair of opposed lateral surfaces of said runner for receiving said plurality of support bars.

13. A pallet assembly comprising at least two elongate, generally hollow, runners sized to support a predetermined load, each of said runners comprising an upper load supporting surface;

a lower surface;

a pair of opposed lateral surfaces, at least one of said pair of opposed lateral surfaces having a plurality of longitudinally spaced apertures formed therethrough; and at least one transverse rib connecting said pair of opposed lateral surfaces;

a plurality of elongate support bars, each of said support bars received within a respective one of the apertures formed through said at least one of said pair of opposed lateral surfaces of said runner; and fastening means for coupling at least two of said plurality of support bars to said runners;

wherein the external surface of at least a portion of some of said plurality of support bars has a spiral groove formed therein.

14. A pallet assembly comprising at least two elongate, generally hollow, runners sized to support a predetermined load, each of said runners comprising an upper load supporting surface;

a lower surface;

a pair of opposed lateral surfaces, at least one of said pair of opposed lateral surfaces having a plurality of longitudinally spaced apertures formed therethrough;

at least one transverse rib connecting said pair of opposed lateral surfaces; said at least one transverse rib comprising a pair of longitudinally extending spaced apart ribs positioned between said upper surface and said lower surface; and an endcap at each opposed end formed by folding the end of said upper surface downward, folding the end of said lower surface upward, folding the ends of said pair of ribs in the direction of said upper surface and said lower surface, respectively, and folding said opposed lateral surfaces inwardly so that said opposed lateral surfaces cover at least a portion of the opposed ends of said runner;

a plurality of elongate support bars having opposed ends received within a respective one of the apertures formed through said at least one of said pair of opposed lateral surfaces of each of said runners; and fastening means for coupling at least two of said plurality of support bars to each of said runners.

15. A pallet sized for supporting a predetermined load, said pallet comprising at least two elongate, generally, hollow, runners extruded from a thermoplastic material, each of said runners comprising an upper load supporting surface having a plurality of longitudinally spaced, vertical apertures formed therethrough;

an opposed lower surface;

a pair of opposed lateral surfaces, at least one of said pair of opposed lateral surfaces having a plurality of longitudinally spaced, transverse apertures formed therethrough; and at least one transverse rib connecting said pair of opposed lateral surfaces;

a plurality of elongate support bars extruded from a thermoplastic material, each of said support bars received within a respective one of the apertures formed through said at least one of said pair of opposed lateral surfaces of said runner, at least a portion of at least some of said support bars having an aperture formed therein, wherein the external surface of at least a portion of at least some of said support bars has a spiral groove formed therein; and fastening means for coupling at least two of said support bars to each of said runners, said fastening means comprising a plurality of fastening members removably secured within a respective one of the apertures formed through said upper surface of said runner and formed in said at least some of said support bars.

16. A method of manufacturing a pallet for supporting a predetermined load comprising the steps of extruding a thermoplastic material to form a predetermined number of elongate, generally hollow runners having a predetermined length, each runner comprising an upper load supporting surface having a plurality of longitudinally spaced apertures formed therethrough, an opposed lower surface, a pair of opposed lateral surfaces, at least one of the opposed lateral surfaces having a plurality of longitudinally spaced apertures formed therethrough, and at least one transverse rib connecting the opposed lateral surfaces;

extruding a thermoplastic material to form a predetermined number of elongate support bars having a predetermined length and opposed ends, at least some of the support bars having an aperture formed therein adjacent each of the opposed ends corresponding to a respective one of the apertures formed through said upper surface of each of said runners; and positioning the opposed ends of the support bars in a respective one of the apertures formed through the at least one of the opposed lateral surfaces of each runner;

wherein the number of apertures formed through said upper surface of each of said runners is less than the number of apertures formed through said at least one of said pair of opposed lateral surfaces of said runner; and wherein the number of apertures formed in each of the opposed ends of the at least some of said support bars is less than the number of apertures formed through said at least one of said pair of opposed lateral surfaces of said runner; and wherein the apertures formed through said upper surface of each of said runners and the apertures formed in at least some of said support bars receive fastening means therein for coupling at least two of said plurality of support bars to each of said runners.

17. A method of repairing a pallet for supporting a predetermined load, the pallet comprising at least two elongate, generally hollow runners extruded from a thermoplastic material and comprising an upper surface, a lower surface, a pair of opposed lateral surfaces and at least one transverse rib connecting the opposed lateral surfaces, at least one of said pair of opposed lateral surfaces having a plurality of longitudinally spaced apertures formed therethrough, a plurality of elongate support bars extruded from a thermoplastic material and having opposed ends, each of the opposed ends of said support bars received within a respective one of the apertures formed through said at least one of said pair of opposed lateral surfaces, and fastening means comprising a plurality of fastening members positioned in a corresponding plurality of apertures formed through the upper surface of each runner and formed in at least some of the support bars adjacent each of the opposed ends, said method comprising the steps of removing the fastening members from the apertures formed through the upper surface of the each runner and formed in the at least some of the support bars;

forming new apertures through the upper surface of each runner, the at least some of the support bars and the at least one transverse rib of each runner; and positioning new, longer fastening members within the new apertures through the upper surface of each runner, the at least some of the support bars and the at least one transverse rib of each runner;

wherein the number of apertures formed through said upper surface of each runner is less than the number of apertures formed through said at least one of said pair of opposed lateral surfaces of said runner; and wherein the number of apertures formed in each of the opposed ends of the at least some of said support bars is less than the number of apertures formed through said at least one of said pair of opposed lateral surfaces of said runner.

* * * * *